US006318245B1

(12) United States Patent
Durth et al.

(10) Patent No.: US 6,318,245 B1
(45) Date of Patent: Nov. 20, 2001

(54) COOKING DEVICE WITH A CATALYST

(75) Inventors: Wilfried Durth, Landsberg/Lech; Peter Wiedemann, Klosterfeld; Gerd Funk, Landsberg, all of (DE)

(73) Assignee: Rational AG, Landsberg/Lech (DE)

( * ) Notice: Subject to any disclaimer, the term of this patent is extended or adjusted under 35 U.S.C. 154(b) by 0 days.

(21) Appl. No.: 09/830,098

(22) PCT Filed: Oct. 22, 1999

(86) PCT No.: PCT/DE99/03414

§ 371 Date: Jun. 13, 2001

§ 102(e) Date: Jun. 13, 2001

(87) PCT Pub. No.: WO00/23750

PCT Pub. Date: Apr. 27, 2000

(30) Foreign Application Priority Data

Oct. 22, 1998 (DE) ..... 298 18 862
Jul. 16, 1999 (DE) ..... 199 33 550

(51) Int. Cl.[7] ..... A23L 1/00; A21B 1/22; F24C 14/00; F24C 15/20; F24C 15/32

(52) U.S. Cl. ..... 99/330; 99/355; 99/476; 126/21 A; 219/400

(58) Field of Search ..... 99/326–334, 337, 99/339, 340, 342, 352–355, 403–417, 467–476, 516, 483; 126/21 A, 20; 219/385, 386, 400, 401, 492, 396; 392/492, 360, 393, 399; 426/523, 509–511

(56) References Cited

U.S. PATENT DOCUMENTS 4,071,738 * 1/1978 Jenn et al. ..... 219/400
4,110,916 * 9/1978 Bemrose ..... 99/476 X
4,113,439 * 9/1978 Ookubo et al. ..... 99/332
4,364,727 * 12/1982 Enga ..... 99/447 X
5,029,519 * 7/1991 Boyen ..... 99/341
5,272,963 * 12/1993 Del Fabbro ..... 99/468
5,423,248 * 6/1995 Smith et al. ..... 219/400 X
5,481,962 * 1/1996 Tedesco ..... 99/330 X
5,499,577 * 3/1996 Tommasini ..... 219/400 X
5,503,061 * 4/1996 Hopkins ..... 99/476
5,615,603 * 4/1997 Polin ..... 99/476 X
5,690,020 * 11/1997 Kitani et al. ..... 99/483 X
5,694,835 * 12/1997 Mangina ..... 99/476 X

* cited by examiner

*Primary Examiner*—Timothy F. Simone
(74) *Attorney, Agent, or Firm*—Schiff Hardin & Waite

(57) ABSTRACT

A cooking device has a cooking chamber, a ventilation device in the form of a ventilating fan wheel or the like and a heating device plus a catalyst. Air from the cooking chamber, including greasy vapors, odor particles, and/or hydrocarbons, can be directed in a finely-atomized form onto the catalyst by the ventilation device. The catalyst purifies the air directed thereon and releases energy in the form of heat during purification, which heat can be distributed inside the cooking chamber by the ventilation device.

11 Claims, 1 Drawing Sheet

COOKING DEVICE WITH A CATALYST

BACKGROUND OF THE INVENTION

The invention is directed to a cooking device having a cooking chamber, a blower chamber, an air baffle, a ventilation means or device in the form of an aerator wheel or the like, a heating device and a catalyst means. The air baffle comprises at least one admission and discharge opening for air circulation between the cooling chamber and the blower chamber. Air, including fat vapors, odor particles and/or hydrocarbons, from the cooking chamber and finely atomized by the ventilation device can be conducted from the cooking chamber onto the catalyst means. The catalyst means cleans the air directed onto it while outputting energy, and the cleaned air and/or the energy released in the cleaning in the form of heat can be distributed into the cooking chamber via the ventilation device. The catalyst of the catalyst means is arranged essentially concentrically around the heating device, and the heating device is arranged essentially concentrically around the ventilation device.

DE 41 39 904 A1 discloses a backing or broiling oven with an oven muffle wherein a motor-driven blower wheel is arranged neighboring the back wall. Concentric therewith, a heating element and a catalyst that is transmissive for the air conveyed by the blower wheel, are arranged successively in a flow direction. In order to achieve a high catalytic effect, the catalyst is fashioned in the form of a sponge whose effective surface is coated with a catalytically active coat.

The article, "Heiβe Platten", in Elektromarkt No. 3, March 1196, pages 16 through 22, discloses the employment of a catalyst for converting odors and fat vapors that arise when baking and frying into pure, humid air. In contrast to other cleaning systems, neither additional time nor power is thereby required, since the catalyst also generates conversion heat that can also be employed for heating the foodstuff to be cooked.

DE 35 16 847 A1 discloses an electric range with a catalyst wherein an externally heated catalyst is introduced into a fume exhaust opening.

An apparatus for separating solid and/or liquid particles from a gas volume having at least one impact surface disclosed by DE 42 06 846 C2.

DE 198 24 172 discloses a cooking device with an energy store and energy removal system that is connected to a measurement and control system already present in a traditional cooking device, so that, on the one hand, heating capacity can be reduced and, on the other hand, waste heat can be used. An energy store can be charged during cooking pauses, which always arise in a batched mode or are caused due to the cooking execution, and/or in a cooking phase wherein a cooking process requires little or no energy with a potentially additional heater controlled via the measurement and control system. Heat energy is stored in the energy store according to a priority hierarchy for assuring an undisturbed implementation of a cooking process, or by the heat from exhaust air emerging from the cooking chamber or, respectively, excess steam that emerges, and energy is taken from the energy store during high-energy cooking phases wherein the cooking process requires a great deal of energy, more than the heater, which is installed for heating the foodstuffs to be cooked, can deliver.

In particular, EP 0 772 514 B1 discloses self-cleaning cooking surfaces that can be realized by artificial implementation of a microscopic surface structure, as known for the lotus blossom, in hydrophobic polymers which are materials rendered durably hydrophobic.

SUMMARY OF THE INVENTION

An object of the present invention is to improve the cooking device of the species to the effect that the disadvantages of the Prior Art are overcome, particularly that coarse dirt, fat splatters and/or the like can be intercepted and does not or, respectively, do not impinge the heating device, so that the heating device is treated with care.

This object is inventively achieved by an impact surface around which the heating device is arranged essentially concentrically, whereby the heating device is arranged at least partially in the flow shadow of the impact surface.

It can thereby be provided according to the invention that the catalyst is fashioned in the form of a plurality of catalyst elements attached to a catalyst housing.

One embodiment of the invention is characterized by an air delivery conduit via which fresh air can be introduced in a controlled fashion, particularly to stimulate an oxidation of fats, odor particles and/or hydrocarbons.

It is also inventively proposed that the impact surface is arranged in the back third of the cooking chamber which is in the exhaust direction.

It is also inventively provided that the impact surface is fashioned in the form of a separator ring for separating solid and/or liquid particles from a gas volume.

Preferably, the heating device is fashioned in the form of at least one, preferably two, annular heating members.

Further, an energy store system and/or energy removal system with catalyst properties is inventively proposed.

It is also inventively provided that the cooking chamber, the energy store system and/or energy removal system and/or the heating device is or, respectively, are equipped and/or coated with a catalyst, at least in regions.

One development of the invention is that the catalyst comprises a surface with a surface structure in dimensions of up to a maximum of 500 $\mu$m and is self-cleaning.

It can be inventively provided that the catalyst comprises aluminum oxide and/or platinum.

The invention is thus based on the surprising perception that, due to the specific arrangement of the impact surface such that the heating device is at least partially arranged in the flow shadow of the impact surface, this heating device can be protected against wear due to the deposit of dirt, fat and/or the like, since the impact surface intercepts such dirt, fat splatters and/or the like. Moreover, the flow that is, so to speak, precleaned via the impact surface can be designationally directed onto the catalyst for enhancing its efficiency.

Inventively, the catalyst can thereby be utilized in the form of individual, separate catalyst elements and/or, on the other hand, as a partial coating of the cooking chamber and/or of an energy store system and/or energy removal system.

Moreover, the catalyst itself can be inventively fashioned such that the surface structure thereof repels dirt.

Additional features and advantages of the invention derive from the following description, wherein an exemplary embodiment of the invention is described in detail on the basis of schematic drawings.

DESCRIPTION OF THE PREFERRED EMBODIMENT

Figure 2:
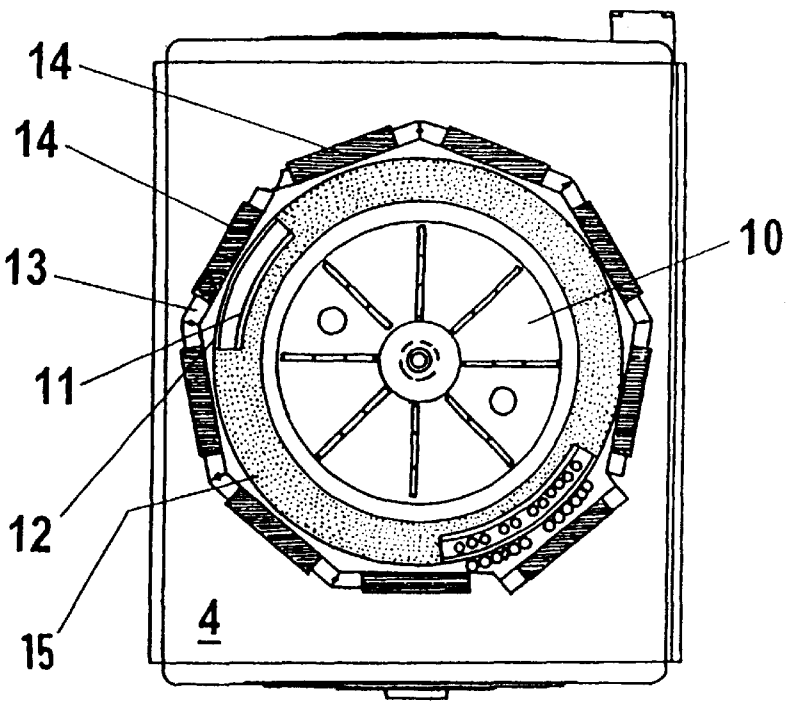
FIG. 2 is a cross-sectional view of the inventive cooking device of FIG. 1.
Figure 1:
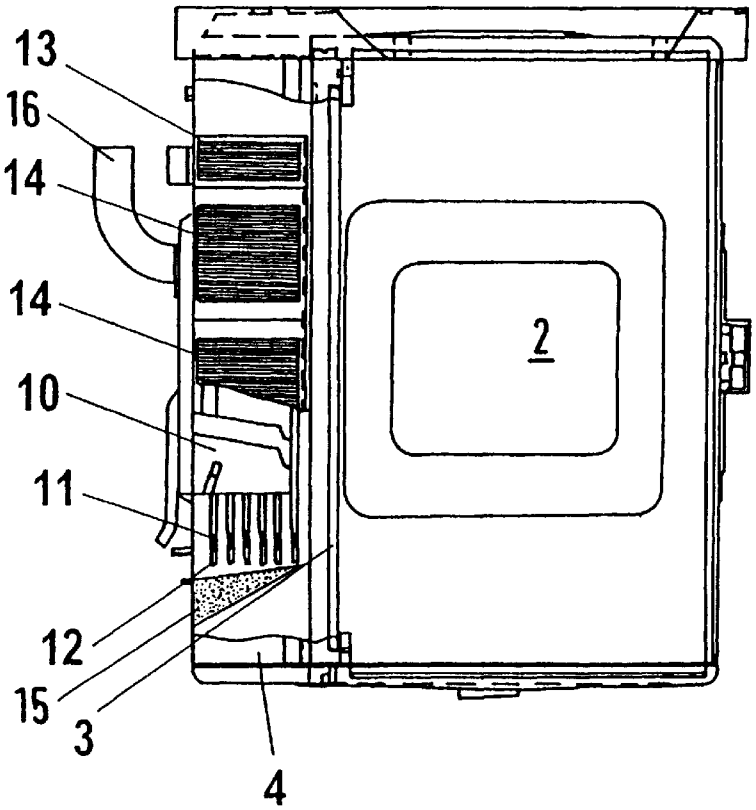
FIG. 1 is a partial longitudinal section through the inventive cooking device.

As can be derived from FIGS. 1 and 2, an inventive cooking device 1 comprises, in particular, a cooking chamber 2 that is separated from a blower chamber 4 by an air baffle 3. The air baffle 3 thereby comprises at least one admission and discharge opening (not shown) for air circulation between the cooking chamber 2 and the blower chamber 4.

A fan wheel 10, two heating members 11, 12, a plurality of catalyst elements 14 attached to a catalyst housing 13 and an impact surface for the separation of solid and/or liquid particles in the form of a separator ring 15 are arranged in the blower chamber 4. An inner heating member 11 is thereby arranged concentric with the fan wheel 10, an outer heating member 12 is arranged concentric with the inner at heating member 11, the separator ring 15 is arranged concentric with the outer heating member 12, and the catalyst elements 14 are arranged concentric with the separator ring 15.

When, for example, chickens are cooked in the cooking chamber 2, then a pronounced formation of odors and production off at vapors occur within the cooking chamber 2. The fan wheel 10 then sees to it that the odor particles and fats are conducted from the cooking chamber 2 into the blower chamber 4 and onto the catalyst elements 14 therein in order to thus enable a conversion of the odor particles and the fats into pure, damp air that can then be resupplied to the cooking chamber 2. As a result of the specific arrangement of the impact surface of the separator ring and of the heating device 11, 12 in the flow shadow of the impact surface, air can be directed in a highly directed fashion onto the catalyst elements 14, so that, in particular, a contamination of the heating device 11, 12 can be avoided.

When cleaning the cooking chamber atmosphere with the catalyst elements, moreover, energy is released that, for example, can be utilized for a further, designational heating of the cooking chamber 2. The inventive cooking device 1, thus, makes it possible to dispose of fats and other hydrocarbons that arise during a cooking process with an energy gain. Since the energy content of animal fats lies, for example, on the order of magnitude of 1 kWh per 100 g, a cost-beneficial and energy-saving air cleaning can be obtained with the inventive structure without, in particular, contamination of the heating device.

Both individually as well as in arbitrary combination, the features of the invention disclosed in the above description, in the claims as well as in the drawings can be critical for realizing the various embodiments of the invention.

We claim:

1. A cooking device comprising a cooking chamber separated from a blower chamber by an air baffle, ventilation means located in the blower chamber for circulating air between the cooking chamber and the blower chamber, an impact surface being arranged concentrically to the ventilation means in the blower chamber, a heating device being arranged concentrically with the impact surface in a flow shadow of the impact surface, catalyst means being disposed in the blower chamber concentrically around the heating device, said ventilation means drawing air including fat vapors, odor particles and/or hydrocarbons from the cooking chamber and directing them in a finely-atomized form onto the catalyst means, said catalyst means cleaning the air directed onto it while outputting energy, said ventilation means taking air cleaned by the catalyst means and heat energy released during cleaning and distributing it to the cooking chamber.

2. A cooking device according to claim 1, wherein the catalyst means is fashioned in the form of a plurality of catalyst elements attached to a catalyst housing concentrically surrounding the heating device and impact surface.

3. A cooking device according to claim 1, which includes air delivery conduits via which fresh air can be introduced in a controlled fashion to stimulate oxidation of fats, odor particles and hydrocarbons.

4. A cooking device according to claim 1, wherein the impact surface is arranged in a back region of the blower chamber in the exhaust direction.

5. A cooking device according to claim 1, wherein the impact surface is fashioned in the form of a separator ring for separating solid and liquid particles from a gas volume.

6. A cooking device according to claim 1, wherein the heating device is fashioned in the form of at least two preferably annular heating members.

7. A cooking device according to claim 1, which includes an energy store system and an energy removal system with catalytic properties.

8. A cooking device according to claim 7, wherein at least one of the cooking chamber, the energy store system, the energy removal system and the heating device has at least regions provided with a catalyst.

9. A cooking device according to claim 1, wherein the catalyst of the catalyst means comprises a surface with a surface structure in dimensions of up to a maximum of 500 $\mu$m and the catalyst is self-cleaning.

10. A cooking device according to claim 1, wherein the catalyst is selected from aluminum oxide, platinum and a combination of aluminum oxide and platinum.

11. A cooking device according to claim 1, wherein at least one of the cooking chamber and the heating device has a region provided with a catalyst material of the catalyst means.

* * * * *